United States Patent [19]

Winnard

[11] Patent Number: 4,971,167

[45] Date of Patent: Nov. 20, 1990

[54] LADDER SUPPORT APPARATUS

[76] Inventor: Keith E. Winnard, 1147 Fresno Ave., Berkeley, Calif. 94707

[21] Appl. No.: 439,151

[22] Filed: Nov. 20, 1989

[51] Int. Cl.[5] ..... E06C 5/36; E06C 7/42

[52] U.S. Cl. ..... 182/107; 182/165

[58] Field of Search ..... 182/107, 165, 166, 169, 182/173

[56] References Cited

U.S. PATENT DOCUMENTS

| | | | |
|---|---|---|---|
| 840,365 | 1/1907 | Pease | 182/107 |
| 1,521,814 | 1/1925 | Houska | 182/165 |
| 1,710,026 | 4/1929 | McCormick | 182/107 |
| 2,523,535 | 9/1950 | Little | 182/107 |
| 2,574,286 | 11/1951 | Rein | 182/165 |
| 4,130,181 | 12/1978 | McCallum | 182/107 |

FOREIGN PATENT DOCUMENTS

| | | | |
|---|---|---|---|
| 2172044 | 9/1986 | United Kingdom | 182/165 |
| 2182086 | 5/1987 | United Kingdom | 182/165 |

*Primary Examiner*—Reinaldo P. Machado

*Attorney, Agent, or Firm*—Leon Gilden

[57] ABSTRACT

An apparatus is set forth wherein a plurality of spaced tubular supports include pivotally mounted angular feet at their lower terminal ends. The supports each telescopingly receive an inner support, wherein each inner support includes a "C" shaped rigid jaw for positioning about a rung of an associated ladder to provide support to the ladder. The parallel supports include spaced sleeves, wherein the sleeves include tab members, wherein each respective tab member pivotally mounts an elongate link. Each link is defined by an enclosed slot, wherein the slots overlap and include connector clamps to space the links and the supports relative to one another to provide an organization securely positioning and maintaining a ladder in a predetermined orientation.

6 Claims, 4 Drawing Sheets

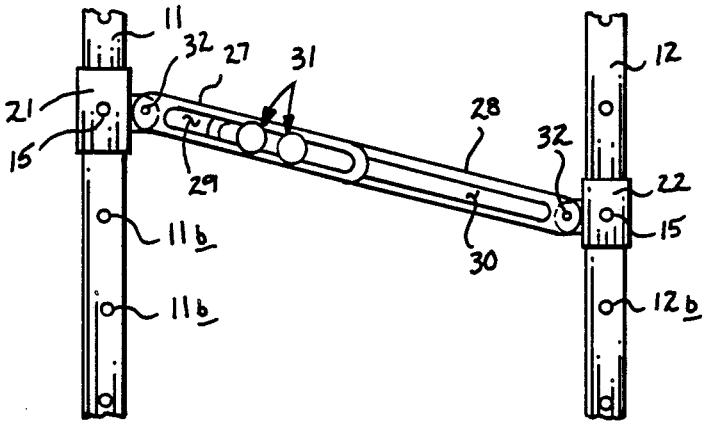
FIG 5
FIG 6
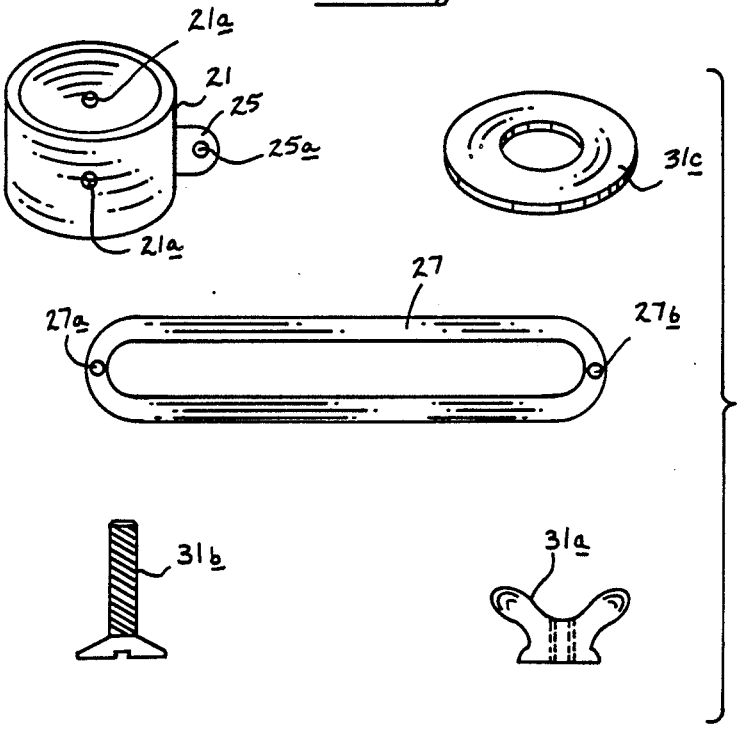

LADDER SUPPORT APPARATUS

BACKGROUND OF THE INVENTION

1. Field of the Invention

The field of invention relates to ladder supports, and more particularly pertains to a new and improved ladder support apparatus wherein the same includes spaced supports to provide stability to an associated ladder to effect triangulation of the ladder with respect to a surface.

2. Description of the Prior Art

The use of ladder supports is well known in the prior art. Heretofore ladder supports of the prior art have been of an organization providing limited accommodation to ladder structure, or have been of a relatively complex organization in use. Examples of the prior art include U.S. Pat. No. 840,365 to Pease wherein a plurality of spaced links are rigidly mounted relative to one another, wherein an upper portion of each link enables grasping of an associated ladder rung with a lowermost link securable to a lower ladder rung to effect triangulation of the ladder and support thereof.

U.S. Pat. No. 1,294,345 to Maxwell sets forth a ladder support wherein a "T" shaped support member is securable to a lowermost rung of a ladder, wherein the support provides a single telescoping member to secure the ladder rung.

U.S. Pat. No. 2,419,065 to Fowler provides a plurality of elongate links securable to opposed sides of a ladder to provide stability to the ladder in use. The links are mounted to brackets that are in turn fixedly mounted to the spaced sides of the ladder.

U.S. Pat. No. 1,710,026 to McCormick sets forth a triangulated bracket formed with a lowermost leg and is securable to spaced rungs of a ladder to provide support to the ladder in use.

U.S. Pat. No. 4,655,322 to Mittanack provides a ladder stabilizing device wherein spaced legs independent of one another are securable to opposed sides of the ladder.

As such, it may be appreciated that there is a continuing need for a new and improved ladder support apparatus wherein the same addresses both the problems of ease of use and effectiveness in the stabilizing and triangulation of a ladder relative to a base, and in this respect, the present invention substantially fulfills this need.

SUMMARY OF THE INVENTION

In view of the foregoing disadvantages inherent in the known types of ladder supports now present in the prior art, the present invention provides a ladder support apparatus wherein the same addressably is securable to a selective rung of a ladder, wherein the organization includes spaced supports to effect triangulation of the ladder relative to a support base and the spaced supports are linked in an adjustable manner relative to one another to accommodate variations in ground support contours. As such, the general purpose of the present invention, which will be described subsequently in greater detail, is to provide a new and improved ladder support apparatus which has all the advantages of the prior art ladder supports and none of the disadvantages.

To attain this, the present invention includes an apparatus wherein a plurality of spaced tubular supports include pivotally mounted angular feet at their lower terminal ends. The supports each telescopingly receive an inner support, wherein each inner support includes a "C" shaped rigid jaw for positioning about a rung of an associated ladder to provide support to the ladder. The parallel supports include spaced sleeves, wherein the sleeves include tab members, wherein each respective tab member pivotally mounts an elongate link. Each link is defined by an enclosed slot, wherein the slots overlap and include connector clamps to space the links and the supports relative to one another to provide an organization securely positioning and maintaining a ladder in a predetermined orientation.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed invention of the application, which is measured by the claims, nor is it intended to be limiting as to the scope of the invention in any way.

It is therefore an object of the present invention to provide a new and improved ladder support apparatus which has all the advantages of the prior art ladder supports and none of the disadvantages.

It is another object of the present invention to provide a new and improved ladder support apparatus which may be easily and efficiently manufactured and marketed.

It is a further object of the present invention to provide a new and improved ladder support apparatus which is of a durable and reliable construction.

An even further object of the present invention is to provide a new and improved ladder support apparatus which is susceptible of a low cost of manufacture with regard to both description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the materials and labor, and which accordingly is then susceptible of low prices of sale to the consuming public, thereby making such ladder support apparatus economically available to the buying public.

Still yet another object of the present invention is to provide a new and improved ladder support apparatus which provides in the apparatuses and methods of the prior art some of the advantages thereof, while simultaneously overcoming some of the disadvantages normally associated therewith.

Still another object of the present invention is to provide a new and improved ladder support apparatus wherein the same provides a plurality of spaced telescoping supports, wherein the spaced supports are linked relative to one another by pivotally mounted link members to accommodate variations in ground support contours.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 5 is an orthographic frontal view taken in elevation of the pivotal link connector accommodating an uneven terrain.

FIG. 6 is an isometric illustration of various components in use to define the link coupler.

DESCRIPTION OF THE PREFERRED EMBODIMENT

Figure 1:
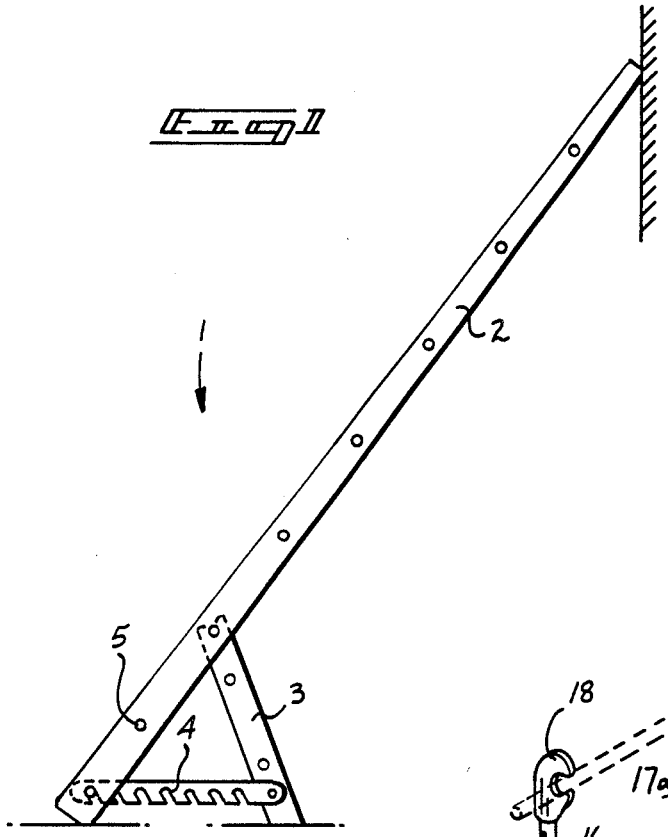
FIG. 1 is an orthographic view taken in elevation of a prior art ladder support arrangement.
Figure 2:
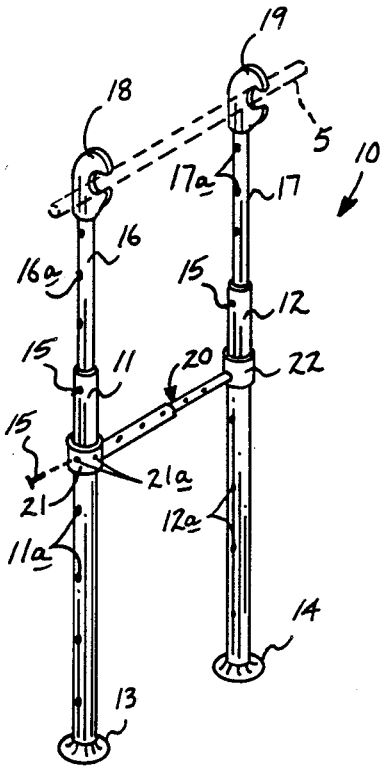
PRIOR ART FIG 2
FIG. 2 is an isometric illustration of the instant invention.

With reference now to the drawings, and in particular to FIGS. 1 to 8 thereof, a new and improved ladder support apparatus embodying the principles and concepts of the present invention and generally designated by the reference numeral 10 will be described.

FIG. 1 is illustrative of a typical prior art device 1 wherein a ladder 2 provided with a series of spaced rungs 5 is in association with a support member defined by a first link resting upon a ground support at one end and supporting an upper rung at its other end, with a lower link secured to the first link at one end and to a lower rung at its other end to effect triangulation relative to the ladder 2 and provide support thereof.

More specifically, the ladder support apparatus 10 comprises a first cylindrical support tube 11 spaced from a second cylindrical support tube 12. The support tubes include respective first and second pivotal support foot members 13 and 14 that are pivotally mounted to lower terminal ends of the first and second support tubes 11 and 12. First and second respective telescoping tubes 16 and 17 are slidably received within the respective first and second support tubes 11 and 12 and include lock pins 15 that are directed through aligned pairs of apertures defined by first tube apertures 11*a* and second support tube apertures 12*a* that are alignable with respective first telescoping tube aperture 16*a* and second telescoping tube aperture 17*a* to position the respective support tubes and telescoping tubes relative to one another in a predetermined and adjustable manner. Each upper terminal end of the respective first and second telescoping tube 16 and 17 are provided with equally proportioned first and second "C" shaped rigid jaws 18 and 19 that are mounted to receive a ladder rung 5 therewithin. A coupler 20, to be described in more detail below, maintains the support tubes at a predetermined spaced relationship relative to one another to maintain integrity of the organization in use.

Figure 3:
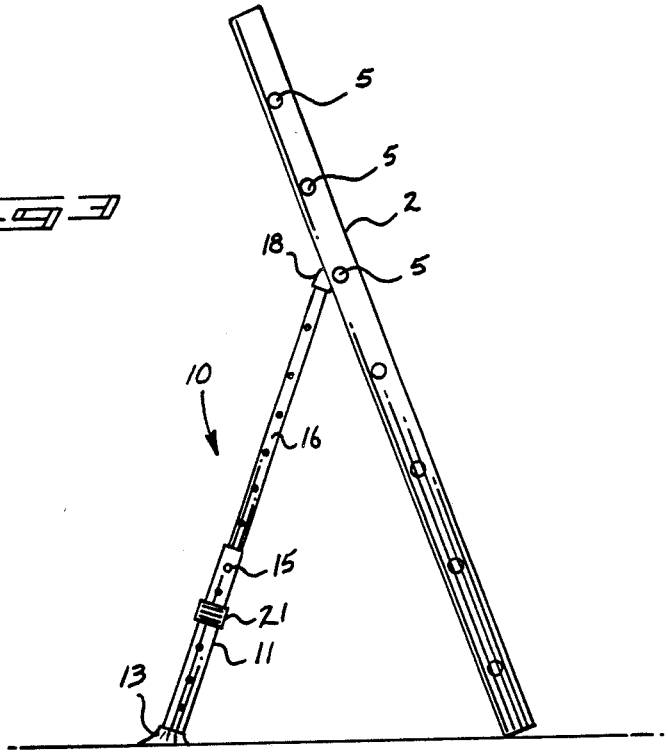
FIG. 3 is an orthographic side view taken in elevation of the instant invention in association with a ladder.
Figure 4:
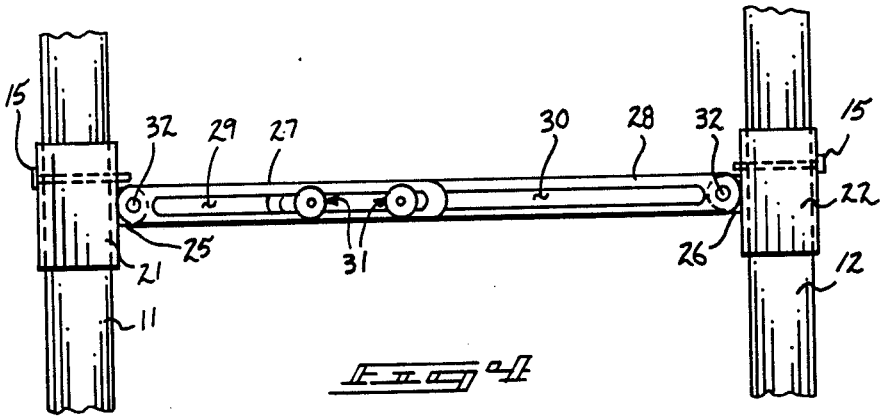
FIG. 4 is an orthographic frontal view of the spaced supports and the link coupler utilized by the instant invention.
Figure 7:
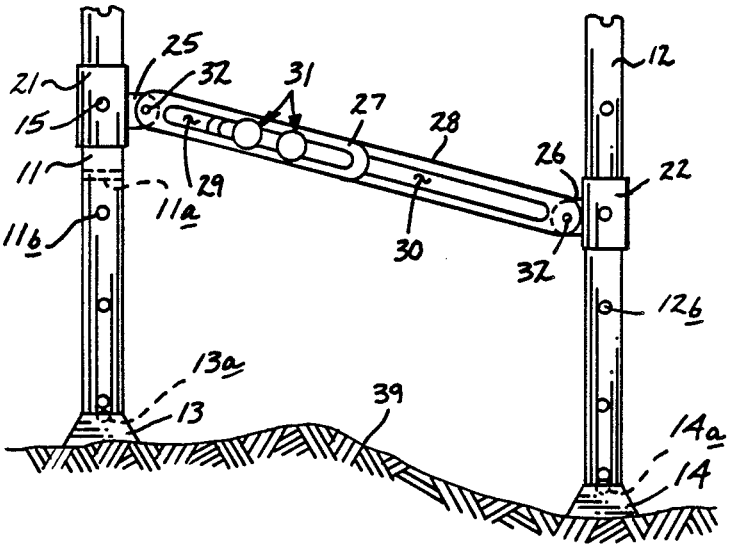
FIG. 7 is an orthographic view taken in elevation of the lowermost supports of the instant invention in a combination of an uneven support terrain.

The coupler 20 comprises a first coupler sleeve 21 slidably mounted in surrounding relationship to the first support tube 11 and a second coupler sleeve 22 slidably mounted in a surrounding relationship to the second support tube 12. Each respective first and second coupler sleeve 21 and 22 are of equal configuration and each include a respective first tab 25 and a second tab 26 mounted orthogonally extending from an exterior surface of each coupler sleeve, with the first and second tabs 25 and 26 aligned relative to one another. Each of the tabs includes a respective first and second tab aperture 25*a* and 26*a* to pivotally mount a respective first elongate link 27 and a second elongate link 28 to the respective first and second tabs 25 and 26. The first and second elongate links 27 and 28 are pivotally mounted to the respective first and second tab apertures 25*a* and 26*a* utilizing a pivot connection pin 32. The first and second elongate links 27 and 28 are secured relative to one another by spaced clamps 31. The spaced clamps 31 comprise a wing nut 31*a*, a threaded bolt 31*b*, and a washer 3*ic*, wherein the threaded bolt 31*b* is directed through the respective aligned links with the washer 31*c* mounted over the bolt when extended in position through their links, with the wing nut 31*a* securing the bolt to the links. The first elongate link 27 includes a first elongate enclosed slot 29, wherein the second elongate link 28 is defined by a second elongate enclosed slot 30. The slots are aligned relative to one another, as illustrated in FIG. 4 for example, with a plurality of the clamps 81 directed therethrough to secure the first and second links together. When thusly secured together, the links pivotally mounted at each end accommodate variations in a ground support terrain 39, as illustrated in FIGS. 5 and 7 for example. This enhances the stability of the apparatus in use in support of an associated ladder 2, as illustrated in FIG. 3. The apparatus 10 thereby triangulates and effects support of the ladder in association with a ground support terrain, as illustrated in FIGS. 3 and 7 for example. It should be noted that the first and second coupler sleeves 21 and 22 are adjustably positionable about the respective first and second support tubes 11 and 12 utilizing lock pins 15 directed through associated first and second apertures 21*a* and 21*b*. It is also desirable that the apertures 21*a* include plural pair of such apertures to enable accommodation of lock pins 15 through the first and second support tube apertures 11*a* and 12*a*, as well as through further first and second support tube apertures 11*b* and 12*b*, as illustrated in FIG. 7, to permit improved adjustment as the apertures 11*a* and 11*b* and the apertures 12*a* and 12*b* are positioned at ninety degrees through the respective tubes 11 and 12 and spaced relative to one another to provide additional adjustment of the coupler sleeves 21 and 22.

Figure 8:
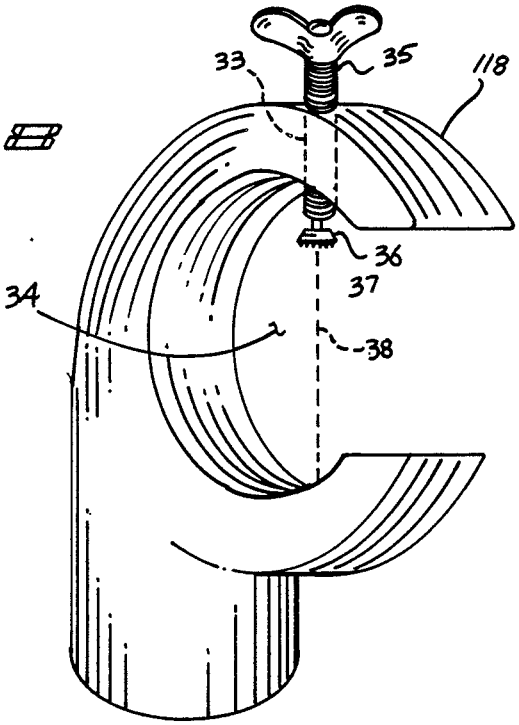
FIG. 8 is an isometric illustration of a modified "C" shaped rigid jaw utilized by the instant invention.

FIG. 8 is illustrative of a modified "C" shaped rigid jaw 118, wherein a plurality of such jaws would be utilized at upper terminal ends of the telescoping tubes 16 and 17. The modified rigid jaw 118 comprises a circular opening 34 positioned medially of the "C" shaped jaw structure of the rigid jaw 118, with a threaded bore 33 diametrically aligned with the diameter 38 of the circular opening 34 of the rigid jaw structure 118. A threaded boss 35 is formed with complementary threads received within the threaded bore 33 and includes a securement wing nut member at its upper end and a swivel head 36 at a lowermost end pivotally mounted to the threaded boss 35. The swivel head 36 is provided with a roughened head contact surface 37 to secure in an enhanced manner a ladder rung 5 when the improved rigid jaw structure 118 mounted to each upper end of the telescoping tubes 16 and 17 that are secured to a ladder rung.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A ladder support apparatus for use with a ladder, wherein the ladder is defined by spaced sides and a series of rung members integrally secured to and spaced at predetermined intervals between said spaced sides, the apparatus comprising, a first support member and a second support member with a respective first and second foot member pivotally mounted to a lower terminal end of the respective first and second support members, and respective first and second telescoping members received within the respective first and second support members, and a first jaw integrally mounted to an upper terminal end of the first support member, and a second jaw integrally secured to an upper terminal end of the second support member, wherein the first and second jaws are configured to receive a rung of the ladder therewithin, and an elongate coupler means for securement of the first and second support members together, wherein the coupler means includes a first sleeve slidably mounted on the first support means, and a second sleeve slidably mounted on the second support means, and a first link pivotally mounted to the first sleeve, and a second link pivotally mounted to the second sleeve, and the first link including a first elongate enclosed slot, and the second link including a second elongate enclosed slot, and a plurality of clamps for adjustably securing the first and second links together, wherein the clamps are directed simultaneously through the first and second enclosed slots, wherein the first and second enclosed slots are aligned and overlapping one another to receive the clamps therethrough to enable adjustment of the first support member relative to the support member.

2. A ladder support apparatus as set forth in claim 1 wherein the first sleeve includes a first tab and the second sleeve includes a second tab, the first and second tabs aligned relative to one another and including a first pivot pin pivotally mounting the first link to the first tab and a second pivot pin pivotally mounting the second link to the second tab.

3. A ladder support apparatus as set forth in claim 2 wherein the first sleeve and second sleeve each include plural pairs of apertures directed therethrough, the plural pairs of apertures aligned at ninety degrees relative to one another and diametrically directed through the first sleeve and the second sleeve, and the first support member and the second support member each including respective first and second pairs of apertures selectively associated with the plural pairs of apertures of the respective sleeves, and a pin member directed through a single of the pair of apertures of the sleeve and through a pair of apertures of the support member to secure the respective sleeve to each respective support member.

4. A ladder support apparatus as set forth in claim 3 wherein the support members and the telescoping members are each of a tubular configuration, with the telescoping members slidably received within the respective support members.

5. A ladder support apparatus as set forth in claim 4 wherein the first jaw and the second jaw are each defined by a "C" shaped rigid jaw.

6. A ladder support apparatus as set forth in claim 5 wherein each "C" shaped rigid jaw is defined by a circular opening, and each jaw further includes a threaded bore diametrically aligned with a diameter defined by each circular opening, and a threaded boss is threadedly received within the threaded bore, and each threaded boss includes a lower swivel head pivotally mounted to a lower terminal end of each threaded boss, wherein the swivel head further includes a roughened contact surface to enhance engagement with a rung of the series of rung members of the ladder.

* * * * *